US010385597B2

(12) United States Patent
Siebert

(10) Patent No.: US 10,385,597 B2
(45) Date of Patent: Aug. 20, 2019

(54) GRAVITY GATE LATCH LOCKABLE AND UNLOCKABLE BY A PADLOCK FROM BOTH SIDES OF A GATE

(71) Applicant: Joshua Steven Siebert, Fresno, CA (US)

(72) Inventor: Joshua Steven Siebert, Fresno, CA (US)

( * ) Notice: Subject to any disclaimer, the term of this patent is extended or adjusted under 35 U.S.C. 154(b) by 342 days.

(21) Appl. No.: 15/145,349

(22) Filed: May 3, 2016

(65) Prior Publication Data

US 2017/0321460 A1 Nov. 9, 2017

(51) Int. Cl.

| | |
|---|---|
| ***E05C 19/02*** | (2006.01) |
| ***E05C 5/00*** | (2006.01) |
| ***E05C 19/00*** | (2006.01) |
| ***E05C 19/12*** | (2006.01) |
| ***E06B 11/02*** | (2006.01) |
| ***E05B 65/00*** | (2006.01) |
| ***E05B 67/38*** | (2006.01) |
| ***E05C 1/10*** | (2006.01) |

(Continued)

(52) U.S. Cl.

CPC ..... *E05C 19/022* (2013.01); *E05B 15/0093* (2013.01); *E05B 65/0007* (2013.01);

(Continued)

(58) Field of Classification Search

CPC ..... Y10T 292/0911; Y10T 292/0921; Y10T 292/0923; Y10T 292/0937; Y10T 292/0941; Y10T 292/0948; Y10T 292/0949; Y10T 292/096; Y10T 292/0961; Y10T 292/0967; Y10T 292/1006; Y10T 292/1011; Y10T 292/102; Y10T 292/1023; Y10T 292/68; Y10T 292/683; Y10T 292/696; Y10T 292/31; Y10T 292/314;

(Continued)

(56) References Cited

U.S. PATENT DOCUMENTS 821,363 A * 5/1906 Jackson ..... E05B 85/247 292/53
989,649 A * 4/1911 Schenck ..... E05B 65/0007 292/120

(Continued)

FOREIGN PATENT DOCUMENTS

AU 25197/35 11/1935

OTHER PUBLICATIONS

Perfect Products, Ultimate Gate Black Double-Sided Locking and Opening Fence Latch (Originally Retrieved on Jun. 7, 2016).

(Continued)

*Primary Examiner* — Alyson M Merlino
(74) *Attorney, Agent, or Firm* — Marcus N. DiBuduo; John R. Aaron

(57) ABSTRACT

A gravity gate latch that is sized and configured to be positioned in the gap between the free end of a gate and a stationary object when the end of the gate is adjacent the stationary object to automatically engage a strike member on the gate. The gate latch has a pair of side plates that are spaced apart to define a space that encloses a lever actuating mechanism and a hook plate. The hook plate has a hook member that engages the strike member of the gate. The lever actuating mechanism has a pair of lever arms, which can be accessed from either side of the gate, that move the hook plate upward to disengage the strike member. A lock receiving member at the bottom of the gate latch receives a padlock to lock the gate latch. The padlock can also be accessed from either side of the gate.

24 Claims, 11 Drawing Sheets

(51) Int. Cl. *E05C 1/12* (2006.01) *E05B 15/00* (2006.01) *E05B 63/16* (2006.01)

(52) U.S. Cl.
CPC ..... *E05B 67/383* (2013.01); *E05C 1/10* (2013.01); *E05C 1/12* (2013.01); *E05C 5/00* (2013.01); *E05C 19/009* (2013.01); *E05C 19/026* (2013.01); *E05C 19/12* (2013.01); *E06B 11/022* (2013.01); *E05B 63/16* (2013.01)

(58) Field of Classification Search
CPC .... E05C 19/022; E05C 19/009; E05C 19/026; E05C 19/12; E05C 19/028; E05C 5/00; E05C 1/10; E05C 1/12; E06B 11/022; E06B 11/021; E06B 11/025; E05B 65/0007; E05B 65/06; E05B 15/0093; E05B 67/383; E05B 63/16
See application file for complete search history.

(56) References Cited

U.S. PATENT DOCUMENTS 1,528,093 A * 3/1925 Anderson ..... E05B 65/0007 292/238
2,592,871 A 4/1952 Dole
2,809,063 A 10/1957 Taylor
3,043,617 A * 7/1962 Shelton ..... E05B 65/06 292/230
3,266,831 A 8/1966 Banse
4,451,072 A 5/1984 Petty, Sr.
4,457,146 A 7/1984 Weinerman
4,592,578 A 6/1986 Martin
5,116,090 A 5/1992 Nichandros
5,243,325 A 9/1993 Marin et al.
5,498,041 A 3/1996 Bezzerides et al.
5,868,446 A 2/1999 Rossmo
6,058,747 A 5/2000 Doyle et al.
6,170,892 B1 1/2001 Lantiegne
8,678,451 B2 3/2014 Martin
2003/0062729 A1 4/2003 Ottens et al.
2008/0224480 A1 9/2008 Mahoney
2011/0215627 A1 9/2011 Wieclawski
2011/0259277 A1 10/2011 Silvis et al.
2015/0159400 A1 6/2015 Seigler

OTHER PUBLICATIONS

International Search Report and Written Opinion relating to continuation application PCT/US17/30655, dated Aug. 7, 2017.

* cited by examiner

GRAVITY GATE LATCH LOCKABLE AND UNLOCKABLE BY A PADLOCK FROM BOTH SIDES OF A GATE

CROSS-REFERENCE TO RELATED APPLICATIONS

None.

STATEMENT REGARDING FEDERALLY SPONSORED RESEARCH

Not Applicable.

REFERENCE TO A SEQUENCE LISTING, A TABLE OR A COMPUTER PROGRAM LISTING APPENDIX SUBMITTED ON A COMPACT DISC

Not Applicable.

BACKGROUND OF THE INVENTION

A. Field of the Invention

The field of the present invention relates generally to gravity-type gate latches that are utilized to control ingress and egress into an area that is accessed through a gate that laterally pivots relative to an upright gate post having a strike member which is releasably engaged by the gate latch. In particular, the present invention relates to such gravity gate latches that can be manually latched and unlatched from either side of the gate. Even more particularly, the present invention relates to such gravity gate latches that allow the user to lock or unlock a lock that is attached to the gate latch from either side of the gate.

B. Background

Fences or similar structures are frequently utilized to enclose an area by defining a border around the area that at least generally prevents unauthorized ingress into and egress from the area. To allow persons, animals, equipment and materials to pass into or out of the enclosed area, most fences include a gate that is sized and configured to allow such passage. With regard to homes, offices and the like that have a yard or other enclosed area, which is typically a back yard, the gate is usually located on one side of the building and pivotally mounted at one end to a gate post so that the gate can swing laterally relative to the gate post to which the gate is mounted. To prevent uncontrolled entry into or exit from the enclosed area through the gate, most gate systems utilize a gate latch that engages either the gate itself or a device attached to the gate, such as a strike member or the like, to place the gate in its closed position. Disengaging the gate latch from the gate or the device attached to the gate allows the gate to be moved to its open position for entering or exiting the enclosed area. Such gate latches are usually mounted to a fixed object so as to be in an opposite facing relationship with the end of the gate having the device, or which is otherwise engaged by the gate latch, that is opposite the end which is pivotally attached to the gate post. Although the fixed object can be the side of the building, most often the gate latch is mounted to a separate post that is attached to the building or mounted in the ground near a side of the building and positioned in spaced apart relation to the gate post.

To allow a person or persons to control or limit access to the enclosed area through the gate, most gate latches are configured to be placed in a locked condition and an unlocked condition. Some gate latches have a built-in or an integrally incorporated locking mechanism that is operated to lock or unlock the gate. The typical gate latch, especially those utilized by homeowners and the like to control ingress and egress through the gate to a back yard, does not have such a locking mechanism. Instead, most such gate latches are configured to be utilized with a separate lock, such as a padlock, that has a shackle which is sized and configured to be placed through an aperture in the gate latch. To place the gate latch in its locked condition, the shackle is inserted through the aperture in the gate latch with the lock portion of the padlock hanging generally below the gate latch (whether the shackle is engaged with and locked to the lock or not). With the shackle disposed through the aperture, the gate latch cannot be moved to its unlocked position and the gate cannot be opened. To open the gate for entry or exit from the enclosed area, the gate latch is moved to its unlocked position by removing the shackle of the padlock from the gate latch (after unlocking the padlock, if necessary) and operating the gate latch to disengage it from the gate or the device attached to the gate. The configuration and use of such gate latches are well known by persons skilled in the relevant art.

A very common type of a gate latch that is utilized with a post mounted pivoting gate is the type that is referred to as a gravity gate latch. A gravity gate latch is generally mounted on a post, herein referred to as the latch post, that is positioned opposite the free swinging end of the gate (i.e., the end of the gate opposite the end pivotally mounted to the gate post) and is configured to engage a strike member that is attached to the free end of the gate when the free end of the gate is adjacent to the gate latch. The standard gravity gate latch has a plate that attaches to the latch post, a bracket that extends perpendicularly from the plate to define a mouth-like opening in which a hook member is allowed to pivot up and down to engage or be disengaged from the strike member attached to the free end of the gate. The gravity gate latch is configured such that when the strike member hits the hook member it causes the hook member to lift upward and allow the strike member inside the mouth area of the bracket. The hook member then falls down, by force of gravity, to trap the strike member inside the mouth area of the bracket to secure the gate in its closed position. A shackle of a padlock is inserted through an aperture in either the hook member (typically) or the bracket to place the gravity gate latch in its locked condition. To open the gate, the shackle of the padlock is removed from the gravity gate latch and the hook member is lifted upward, usually by pushing rearward (toward the latch post) on the hook member to open the mouth area and allow the strike member to be removed therefrom and the gate swung away from the gravity gate latch.

While the locking and unlocking operation of a gravity gate latch is relatively easy from the side of the gate where the gravity gate latch is located, typically inside the enclosed area, most people do not find it easy to lock and unlock the gravity gate latch from the opposite side (i.e., typically outside the enclosed area) of the gate. As well known to persons who utilize gravity gate latches for egress and ingress through a gate, there are many circumstances when a person will be standing on the "wrong" side of the gate to lock/unlock the padlock and operate the gravity gate latch. In standard fence/gate configurations, the gravity gate latch and padlock cannot be easily reached from outside of the gate. Most fences and gates are too high for a person to reach over and manipulate the padlock, whether with a key or a by entering a combination, and operate the gravity gate latch to open the gate. Often, the person wanting to pass through the gate from outside the gate must walk around through the building to access the gravity gate latch from inside the enclosed area. To avoid this problem, many people use a string, cord, wire or other elongated member that passes through a hole from outside the gate to connect to the hook member so he or she may pull on the elongated member to pull on the hook member and allow the strike member to move out of the mouth area of the bracket. Unfortunately, it is relatively easy for these elongated members to become entangled, broken or otherwise useless. In addition, if the padlock is in the gravity gate latch, the elongated member will not be able to be utilized to open the gate.

Another common problem with utilizing gravity gate latches is that they generally have a very low tolerance for the strike member being out of the proper position, which is to be received in the mouth area of the latch. Unfortunately, many gates, particularly wooden gates having wooden posts, tend to sag or shift over time. When they do, the strike member may no longer be aligned with the mouth area of the gravity gate latch such that the strike member will not properly hit the hook member to cause it to raise upward and allow the strike member into the mouth area of the bracket. In any such circumstances, the strike member will hit against and, typically, just rebound off of either the gravity gate latch or the latch post, which will prevent the gate from being placed in its closed position. Once the strike member is out of alignment due to movement of the gate, the gate either must be adjusted or the gravity gate latch must be moved on the latch post to realign the strike member with the hook member.

Another problem with the existing gravity gate latches is that there is no place to conveniently place the padlock when the padlock is removed from the gravity gate latch. Generally, the person removing the padlock from the gravity gate latch will place the padlock on the ground, hang it from the gate or fence, place it in their pocket or just carry it around. As well known to persons who use such gate latches and padlocks, often this results in the person forgetting where he or she placed the padlock or the padlock being placed down somewhere and the person having to look for it.

Despite the general ease of operation and other general advantages of gravity gate latches, the above-described problems limit the effectiveness and ease of use of these gate latches. What is needed, therefore, is an improved gravity gate latch that can be utilized with a gate to automatically secure the gate in a closed position and to allow a person to move the gate to its open position that solves the problems identified above. More specifically, what is needed is an improved gravity gate latch that allows a person to easily, conveniently and quickly be able to operate the gate latch from both sides of a gate and to engage or disengage a padlock from both sides of the gate. Preferably, the gravity gate latch will be structured and arranged to be attached to a fixed object, such as the side of a building or on a post, and be able to releasably engage a strike member that is mounted on the free end of a gate which pivots relative to a gate post or the like. The new gravity gate latch should be configured to provide improved tolerance for gates that sag or otherwise shift position. Preferably, the new gravity gate latch will provide a place for a person to store the padlock when it is removed from the gate latch. In its preferred configurations, the new gravity gate latch should be relatively inexpensive to manufacture.

SUMMARY OF THE INVENTION

The gravity gate latch of the present invention provides the benefits and solves the problems identified above. That is to say, the gravity gate latch of the present invention is configured to be utilized with a gate which laterally pivots relative to a gate post so as to automatically secure the gate in a closed position and to easily and conveniently allow a person to move the gate to its open position. More specifically, the gravity gate latch of the present invention allows a person to operate the gate latch from both sides of a gate and to lock and unlock a padlock attached to the gate latch from both sides of the gate, thereby eliminating the need to walk around to unlock the gate latch or to provide a string, cord, wire or other elongated member to open the gate latch. In a preferred configuration, the gravity gate latch of the present invention is structured and arranged to be attached to a side of a building or onto a post and releasably engage a strike member that is mounted on the free end of a laterally swinging gate. The new gravity gate latch provides more tolerance for gates that sag or otherwise shift position. In the preferred configuration, the new gravity gate latch has an aperture that allows a person to store the padlock when it is removed from the gate latch. In one of the preferred configurations, the aperture is positioned to provide the illusion that the stored lock is securing the gate in its closed position. In a preferred configuration, the new gravity gate latch is relatively inexpensive to manufacture.

The gravity gate latch of the present invention allows the user to securely and automatically latch a gate, such as a wooden gate. The mounting location of the gravity gate latch between the stationary or fixed latch post and the free end of the gate allows the user to latch, unlatch, lock and unlock the new gate latch from both sides of the gate (i.e., inside and outside relative to the enclosed area). The gravity gate latch of the present invention has outwardly extending lever arms on both sides of the latch, which correspond to both sides of the gate, that project beyond both sides of the gate to allow easy opening of the new gate latch from either side of the gate. The new gravity gate latch can be utilized on single gates and double gates. When utilized with a padlock, the gravity gate latch of the present invention can be easily and conveniently locked and unlocked, by locking or unlocking the padlock, from both sides of the gate. The new gravity gate latch has two operating options for disengaging the gate from the latch: (1) pushing down on a lever; and (2) pulling up on the hook plate, which is the plate that the hook is attached to or, preferably, integrally formed.

In one embodiment of the present invention, the new gravity gate latch generally comprises a first side plate, a second side plate, a hook plate, a lever actuating mechanism and a lock receiving member. The second side plate is securely attached to the first side plate. Each of the side plates are configured to define a latch mouth at a first side of the gate latch. The latch mouth is sized and configured to receive a strike member that is attached to or integral with the first end of the gate when the gate is in its closed condition. A plurality of spacers are disposed between the first side plate and the second side plate to position the second side plate in spaced apart relation to the first side plate and define a space between the two plates. The hook plate, which is moveably disposed in the space between the two plates, has a hook member that is attached to or integral with the hook plate. The hook plate positions the hook member in the latch mouth so it can be contacted by the strike member when the gate is moved to its closed position.

The lever actuating mechanism is operatively disposed in the space between the two plates and configured to move the gate latch between a latched condition with the hook member in the latch mouth and an unlatched condition with the hook member generally above the latch mouth. In a preferred configuration, the lever actuating mechanism has a first lever arm, a second lever arm, a guide spacer and a latch hook. Each lever arm is pivotally connected to at least one of the two side plates so as to pivot a second end of one of the lever arms upward when a first end of the lever arm is pressed downward by a person wanting to unlatch the gate latch. The second end of each lever arm is positioned in the space to engage the hook plate and raise the hook plate upward to move the hook member sufficiently above the latch mouth to allow the strike member to move out of the latch mouth when the gate latch is in the latched condition. The guide spacer is attached to one of the two side plates. The latch hook is attached to or integral with the hook plate and sized and configured to be guided upward and downward by the guide spacer when one of the lever arms pivots the hook plate upward. The lock receiving member is attached to the latch hook generally below the lower ends of the two side plates when the gate latch is in the latched condition. The lock receiving member has an aperture that is sized and configured to receive a shackle of a padlock to place the gate latch in a locked condition, which prevents upward movement of the hook plate and placement of the gate latch in an unlatched condition.

The gate latch is sized and configured to be positioned in a gap between the first end of the gate and the stationary object with the first and second sides of the gate latch being disposed on opposite sides of the gate (i.e., generally toward opposite areas separated by the gate) so as to receive the strike member in the latch mouth to place the gate latch in the latched condition. The user raises the hook plate to unlatch the gate by pressing down on one of the lever arms to place the gate latch in an unlatched condition. The gate latch also disposes the padlock in the gap between the first end of the gate and the stationary object to allow a user to access the padlock from either side of the gate. A new gate system includes the gate, stationary object, gap between the gate and stationary object, strike member on the gate and the above-described latch.

Accordingly, the primary object of the present invention is to provide a new gravity gate latch and gate system that has the advantages discussed above and which overcomes the various disadvantages and limitations that are associated with presently available gravity gate latches and gate systems.

It is an important object of the present invention to provide a new gravity gate latch that is positioned between the free end of a gate and a stationary object to securely and automatically engage the gate with the gate latch to place the gate in its closed position so the gate latch can be easily and conveniently accessed from either side of the gate to disengage the gate from the latch and to unlock or lock a padlock that is attached to the gate latch.

An important aspect of the present invention is that it provides a new gravity gate latch that accomplishes the objectives set forth above and elsewhere in the present disclosure.

Another important aspect of the present invention is that it provides a new gravity gate latch that is utilized to automatically and securely place a gate in its closed position, with the gate latch being sized and configured to be attached to a stationary object opposite from a free end of the gate to engage a component of the gate, such as a strike member attached to or integral with the gate.

Another important aspect of the present invention is that it provides a new gravity gate latch that is structured and arranged to allow a person to easily and conveniently disengage a gate from the gate latch from either side of the gate without having to reach over the gate, go around to the other side of the gate or utilize a string, cord, wire or other elongated member.

Another important aspect of the present invention is that it provides a new gravity gate latch that is configured to be utilized with a padlock to place the gate in its locked condition, with the gate latch being structured and arranged to allow a person to easily and conveniently lock and unlock the padlock, and therefore the gate itself, from either side of the gate.

Another important aspect of the present invention is that it provides a new gate latch that is configured to be attached to a fixed object, such as a latch post or wall, opposite the free end of a swinging gate with a lever arm extending outwardly from each side of the gate latch that can be easily and conveniently accessed to disengage the gate from the gate latch.

Another important aspect of the present invention is that it provides a new gravity gate latch that has a center disposed pull plate that allows the user to pull upward on the hook that engages the gate, or a strike attached to the gate, to disengage the gate from the gate latch.

Another important aspect of the present invention is that it provides a new gravity gate latch that has an elongated latch mouth and hook member edge that provides greater tolerance with regard to receiving a strike member that is attached to or integral with gates that have a tendency to sag, shift or otherwise move due to wood swelling, disrepair or improper build.

Another important aspect of the present invention is that it provides a new gravity gate latch that includes a padlock aperture that allows the user to store a padlock when not in use and to provide the illusion that the gate is locked even though the padlock is not preventing the unlatching of the gate.

Yet another important aspect of the present invention is that it provides a new gravity gate latch that is relatively inexpensive to manufacture.

As will be explained in greater detail by reference to the attached figures and the description of the preferred embodiment which follows, the above and other objects and aspects are accomplished or provided by the present invention. As set forth herein and will be readily appreciated by those skilled in the art, the present invention resides in the novel features of form, construction, mode of operation and combination of processes presently described and understood by the claims. The description of the invention which follows is presented for purposes of illustrating one or more of the preferred embodiments of the present invention and is not intended to be exhaustive or limiting of the invention. The scope of the invention is only limited by the claims which follow after the discussion.

BRIEF DESCRIPTION OF THE DRAWINGS

In the drawings which illustrate the preferred embodiments and the best modes presently contemplated for carrying out the present invention.

DETAILED DESCRIPTION OF THE PREFERRED EMBODIMENTS

With reference to the figures where like elements have been given like numerical designations to facilitate the reader's understanding of the present invention, the preferred embodiments of the present invention are set forth below. The enclosed figures are illustrative of several potential preferred embodiments and, therefore, are included to represent several different ways of configuring the present invention. Although specific components, materials, configurations and uses are illustrated, it should be understood that a number of variations to the components and to the configuration of those components described herein and shown in the accompanying figures can be made without changing the scope and function of the invention set forth herein. For instance, although the description and figures included herewith generally describe and show particular materials, shapes and configurations for the various components of the new gravity gate latch of the present invention, as well as the gate and gate system with which the gate latch can be utilized, those skilled in the art will readily appreciate that the present invention is not so limited. In addition, the exemplary embodiment of the present apparatus is shown and described herein with only those components that are required to disclose the present invention. As such, many of the necessary mechanical elements for attaching and using the present invention are not shown or necessarily described below, but which are well known to persons skilled in the relevant art. As will be readily appreciated by such persons, the various elements of the present invention that are described below may take on any form consistent with forms that are readily realized by a person of ordinary skill in the art having knowledge of gravity gate latches, gate systems and gates.

Figure 2:
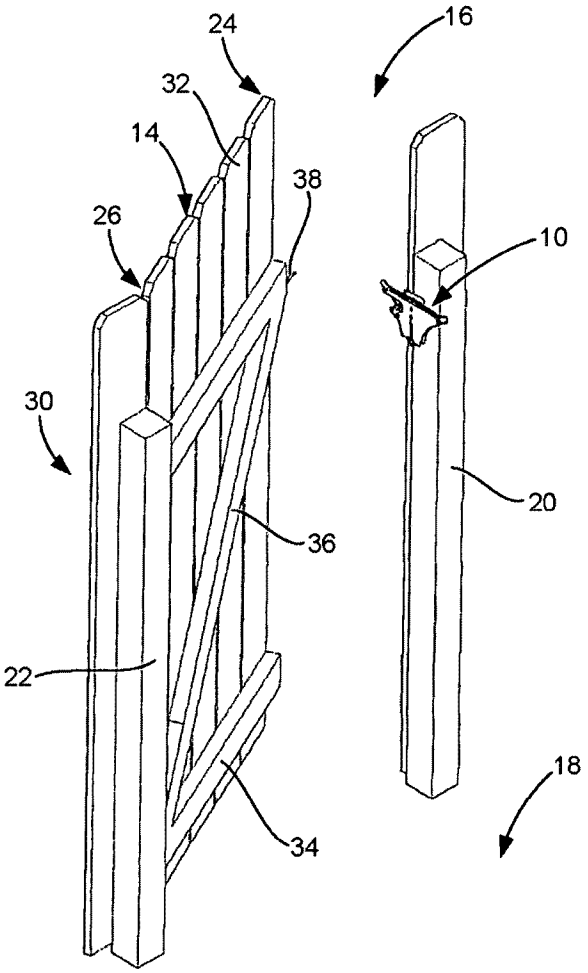
FIG. 2 is a back perspective view of the gate system of FIG. 1 with the gate shown in its open position to better show the new gravity gate latch and the strike member that is receivedly engaged by the gate latch.
Figure 1:
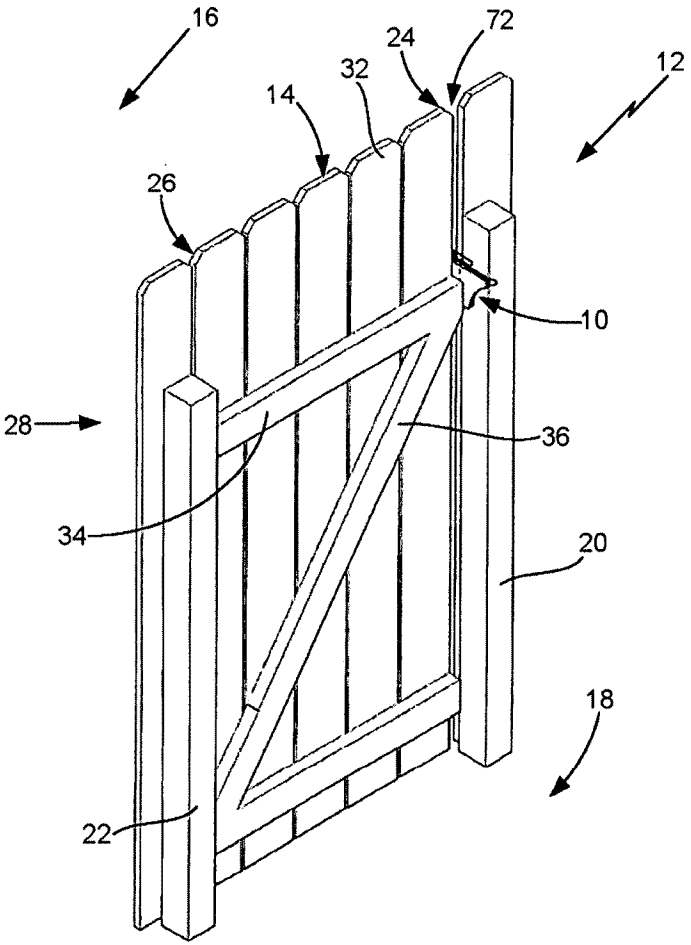
FIG. 1 is a back perspective view of a gate system having a gate and using a gravity gate latch that is configured according to one of the preferred embodiments of the present invention to secure the gate in its closed position.
Figure 4:
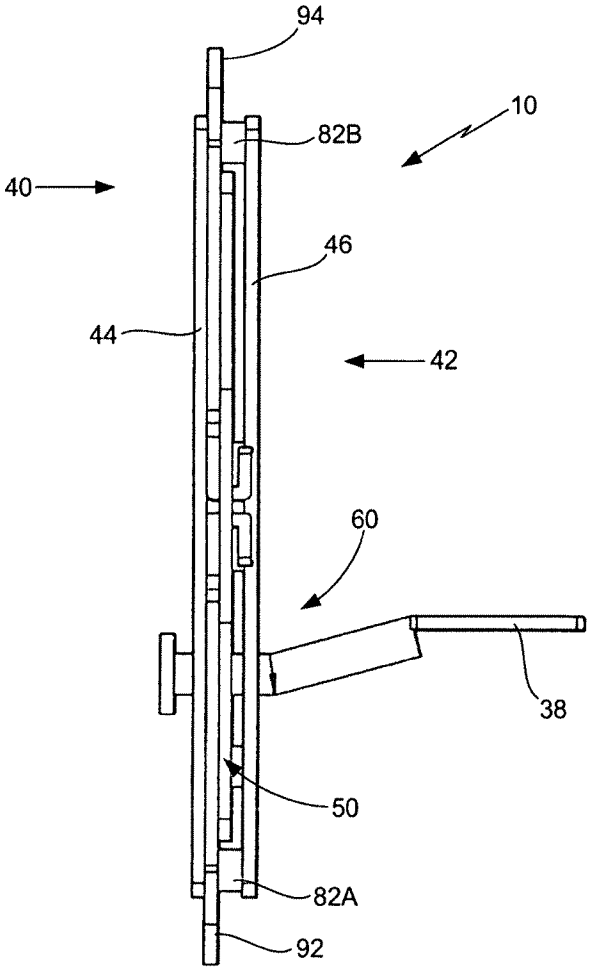
FIG. 4 is a top view of the gravity gate latch of FIG. 3.
Figure 3:
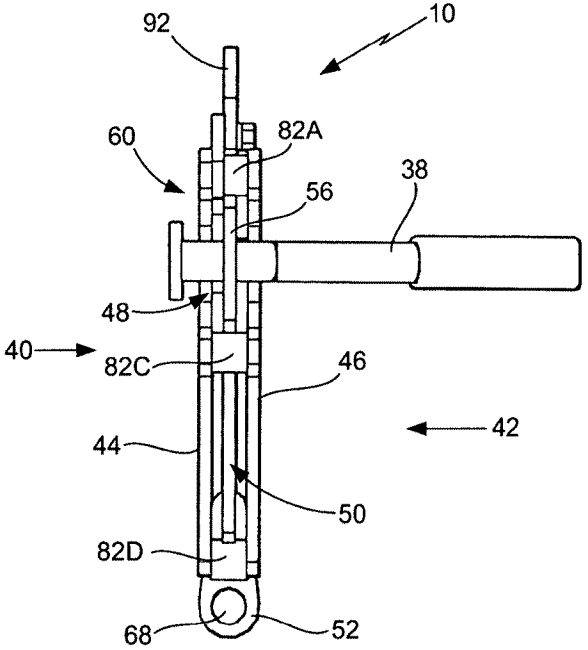
FIG. 3 is a front view of the gravity gate latch of FIG. 1 shown separate from the gate system.
Figure 5:
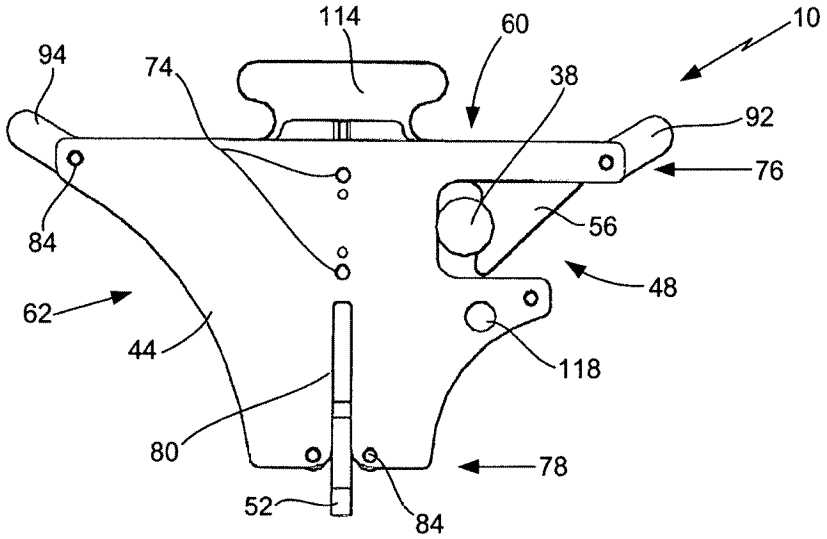
FIG. 5 is a left side view of the gravity gate latch of FIG. 3 shown in its engaged condition with the strike member being engaged by the hook member of the gate latch.

A gravity gate latch that is configured pursuant to one of the preferred embodiments of the present invention is referred to generally as 10 in FIGS. 1-15. The new gravity gate latch 10, herein referred to as the "gate latch", is utilized with a gate system 12 having at least one gate 14 associated therewith, as shown in FIGS. 1 and 2. As will be readily appreciated by persons skilled in the art, the gate system 12 and gate 14 shown in FIGS. 1 and 2 are typical of gate systems and gates that are utilized with a fence (not shown), which is used to enclose an area (also not shown) to allow a person to enter into or exit from the enclosed area. For purposes of describing the present invention, the gate system 12 is configured for the gate to open outward to the outside or front area 16 and then swing back toward the enclosed or back area 18 (i.e., as if used to control entry or exit from the back yard of a house). The views of the gate latch 10 shown in the figures are referenced as from the front area 16 or the back area 18. As will be understood by those skilled in the art, the gate system 12 and the placement of the gate latch 10 of the present invention are not limited to the exemplary gate system 12 shown in FIGS. 1 and 2. For instance, the gate system 12 can be configured for the gate 14 to open in the opposite direction (i.e., towards the back area 18) instead of toward the front area 16, with the gate latch 10 of the present invention being positioned to engage the gate 14 or a component thereof, as set forth below.

In addition to the gate latch 10 and gate 14, the gate system 12 of FIGS. 1 and 2 comprises a first stationary or fixed object 20 to which the gate latch 10 is attached. For purposes of the present disclosure, the first stationary object 20 is a post that is, typically at least partially buried in the ground, concrete or other material or is attached to another stationary object (such as a wall) or part of the fence structure. The first stationary object 20 is referred to herein as a latch post (hereinafter identified as latch post 20). As well known in the art, however, the first stationary object can be a wall of a building, such as a house, or another object that is fixed in position to engage the gate 14. The gate 14 is hingedly attached to a second stationary or fixed object 22 so it can laterally swing relative thereto. For purposes of the present disclosure, the second stationary object 22 is also a post that is, typically at least partially buried in the ground, concrete or other material or is attached to another stationary object (such as a wall) or part of the fence structure. The second stationary object 22 is referred to herein as a gate post (hereinafter identified as gate post 22). As well known in the art, however, the second stationary object can be a wall of a building, such as a house, or another object that is fixed in position to hingedly (typically) support the gate 14. The gate 14 has a first or free end 24 and a second end 26, which is pivotally attached to the gate post 22, as shown in FIGS. 1 and 2. The gate 14 is positioned such that the first (or free) end 24 thereof is aligned with and opposite of the latch post 20 when the gate 14 is in its closed position 28, as shown in FIG. 1. When not engaged with the gate latch 10, the gate 14 is free to swing away from the gate latch 10 and latch post 20 to its open position 30, as shown in FIG. 2.

The gate 14, latch post 20 and gate post 22 shown in FIGS. 1 and 2 are made out of wood, having a plurality of vertical, generally upright positioned pickets 32, one or more horizontally disposed rail members 34 and one or more angled support members 36. As will be readily appreciated by persons skilled in the art, however, the gate 14, latch post 20 and gate post 22 can be made out of a wide variety of materials, including steel, aluminum, fiberglass and the like, and in a wide variety of different configurations. The gate latch 10 and gate 14 are cooperatively configured so the gate latch 10 will securely engage a component of the gate 14 or a device that is attached to the gate 14 to secure the gate 14 in its closed position 28, as shown in FIG. 1. In a typical gravity gate latch gate system, such as the gate system 12, a strike member 38 is attached to or integral with the first (or free) end 24 of the gate 14 so as to extend generally outwardly therefrom, as shown in FIG. 2. As described in more detail below, a portion of the strike member 38 is sized and configured to be engaged by the gate latch 10.

Figure 10:
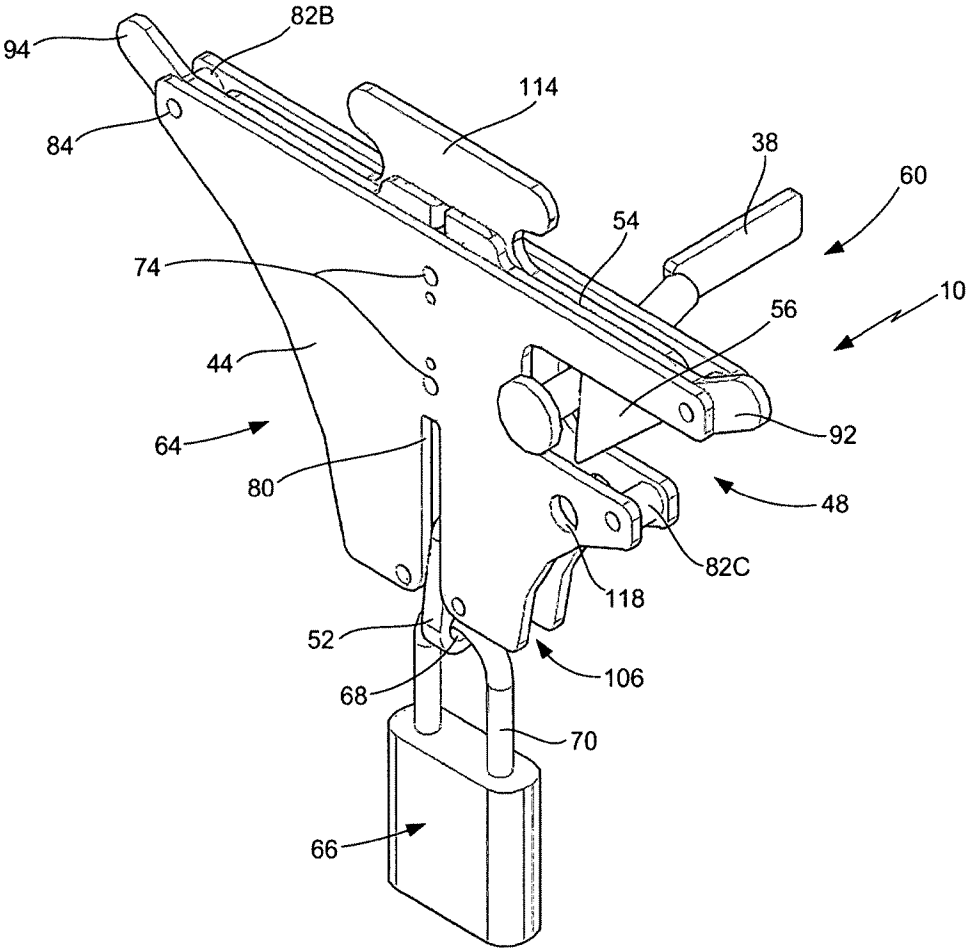
FIG. 10 is a left side perspective view of the gravity gate latch of FIG. 9 shown in its locked position with a padlock.

For purposes of describing the gate latch 10 of the present invention, the gate latch 10 has a first (or post) side 40 that is positioned, typically, in abutting relationship with the latch post 20 (first stationary object) and a second (or gate) side 42 that faces toward the first (or free) end 24 of the gate 14 when the gate 14 is in its closed position 28, as shown in FIG. 1. As will be described in more detail below, gate latch 10 generally comprises a first (or post) side plate 44, a second or gate side plate 46, a latch mouth 48 defined by the first plate 44 and second plate 46, a lever actuating mechanism 50 enclosed by the first side plate 44 and second side plate 46, a lock receiving member 52 attached to or integral with the lever actuating mechanism 50 and a hook plate 54 that is moved by the lever actuating mechanism 50 to move a hook member 56 generally upward and downward, as best shown in FIGS. 3-15. When the hook member 56 is up, as shown in FIGS. 6-8 and 13-15, the gate latch 10 will be in its unlatched condition 58 and the strike member 38 will be able to move into or out of the latch mouth 48 (i.e., when moving from or to the open position 30 of gate 14). When the strike member 38 is in the latch mouth 48 and the hook member 56 is down, the hook member 56 traps the strike member 38 in the latch mouth 48 of the gate latch 10 to place the gate latch 10 in its latched condition 60 and, when the gate latch 10 is in use with the gate 14, place the gate 14 in its closed position 28, as best shown in FIGS. 1, 3-5, and 10. Normally, the gate latch 10 is in an unlocked condition 62 that allows the lever actuating mechanism 50 to move the hook member 56 upward to receive the strike member 38 into the latch mouth 48 or to release the strike member 38 from the latch mouth 48. When the gate latch 10 is in its locked condition 64, the lever actuating mechanism 50 will be unable to move the hook member 56 upward and downward and, in typical use, the strike member 38 will be trapped in the latch mouth 48 of gate latch 10, as shown in FIG. 10. The lock receiving member 52 is structured and arranged to be engaged by a padlock 66 to place gate latch 10 in its locked condition 64. In a preferred configuration, the lock receiving member 52 has an aperture 68, best shown in FIGS. 3, 9-11 and 13-15, that is sized and configured to receive the shackle 70 of a padlock 66, as best shown in FIG. 10.

The gate latch 10 of the present invention is sized and configured to be attached to the latch post 20 and be positioned in a gap 72 between the first (or free) end 24 of the gate 14 and the latch post 20, as shown in FIGS. 1 and 2. In one embodiment, each of the first side plate 44 and second side plate 46 have one or more mounting holes 74, best shown in FIGS. 5-11, that are sized and configured to receive a connecting element (not shown), such as a screw, bolt, nail or the like, that is selected to secure the gate latch 10 to the latch post 20 (or other type of first stationary object). In the embodiment shown in the figures, the first side plate 44 and second side plate 46 have two mounting holes 74. The mounting holes 74 on the first side plate 44 are aligned with the mounting holes 74 on the second side plate 46 so the connecting element can go through both first side plate 44 and second side plate 46, and into latch post 20, or otherwise engage the first stationary object, to secure the gate latch 10 thereto. The first side plate 44 and second side plate 46 have an upper end 76, above which the hook plate 54 moves as a result of the lever actuating mechanism 50 when the gate latch 10 moves to its unlatched condition 58. The first side plate 44 and second side plate 46 also have a lower end 78 below which the lock receiving member 52 hangs when the gate latch 10 is in its latched condition 60. The lock receiving member 52 also hangs below the lower end 78 of first side plate 44 and second side plate 46 when the gate latch 10 is in its locked condition 64, as shown in FIG. 10. In the embodiment shown in the figures, each the first side plate 44 and second side plate 46 also has a slot 80 that is sized and configured to provide for free movement of the lock receiving member 52 as the gate latch 10 moves between its latched condition 60, with the lock receiving member 52 downwardly disposed, and its unlatched condition 58, with the lock receiving member 52 generally upwardly disposed in between the first side plate 44 and second side plate 46.

The first side plate 44 and second side plate 46, which are disposed in spaced apart relation to provide room for the lever actuating mechanism 50, lock receiving member 52 (when up) and hook plate 54, by a plurality of spacers 82A, 82B, 82C, 82D and 82E, best shown in FIGS. 3-4 and 9-15. The first side plate 44 and second side plate 46 are joined together, with the spacers 82A, 82B, 82C, 82D and 82E between, utilizing a plurality of plate connectors 84, which may be rivets, screws, bolts or other devices, that are received through connector apertures 86 in the first side plate 44 and second side plate 46, as best shown in FIGS. 5-15. In addition to keeping the first side plate 44 and second side plate 46 in spaced apart relation, the spacers 82D and 82E at the lower end 78 of the first side plate 44 and second side plate 46 also function as padlock stop members that prevent the shackle 70 of the padlock 66 from moving upward much beyond the lower end 78 of the first side plate 44 and second side plate 46 in order to prevent the shackle 70 interfering with the lever actuating mechanism 50 disposed between the first side plate 44 and second side plate 46. As explained in more detail below, the two spacers 82A and 82B at or near the upper end 76 of the first side plate 44 and second side plate 46 are specially configured to allow components of the lever actuating mechanism 50 to pivot relative to the first side plate 44 and second side plate 46 and, as a result, move the hook plate 54 up and down to move gate latch 10 between its latched condition 60 and unlatched condition 58.

Figure 11:
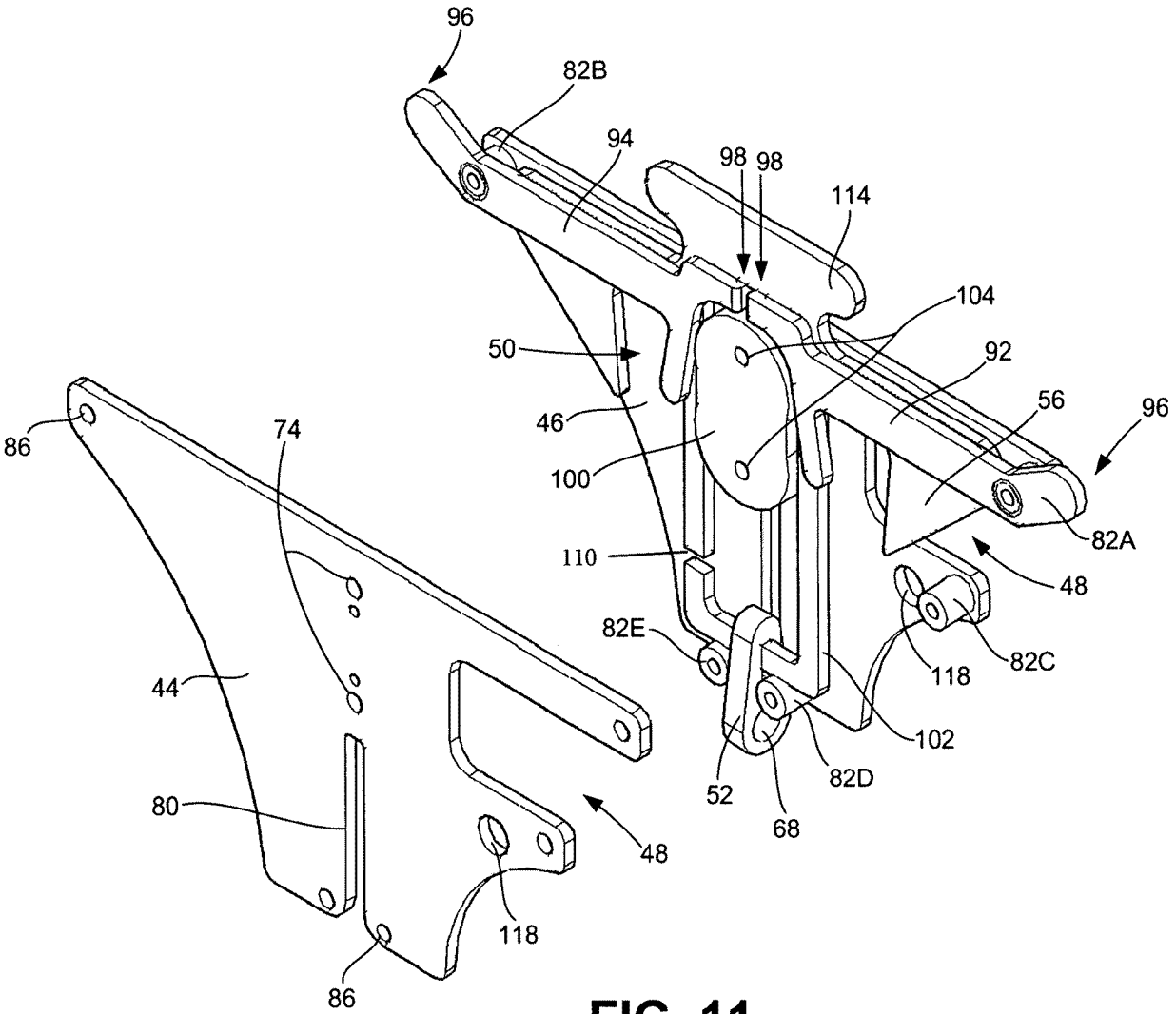
FIG. 11 is a partial exploded left side perspective view of the gravity gate latch of FIG. 9 shown with the first plate separate from the other components of the gate latch.
Figure 12:
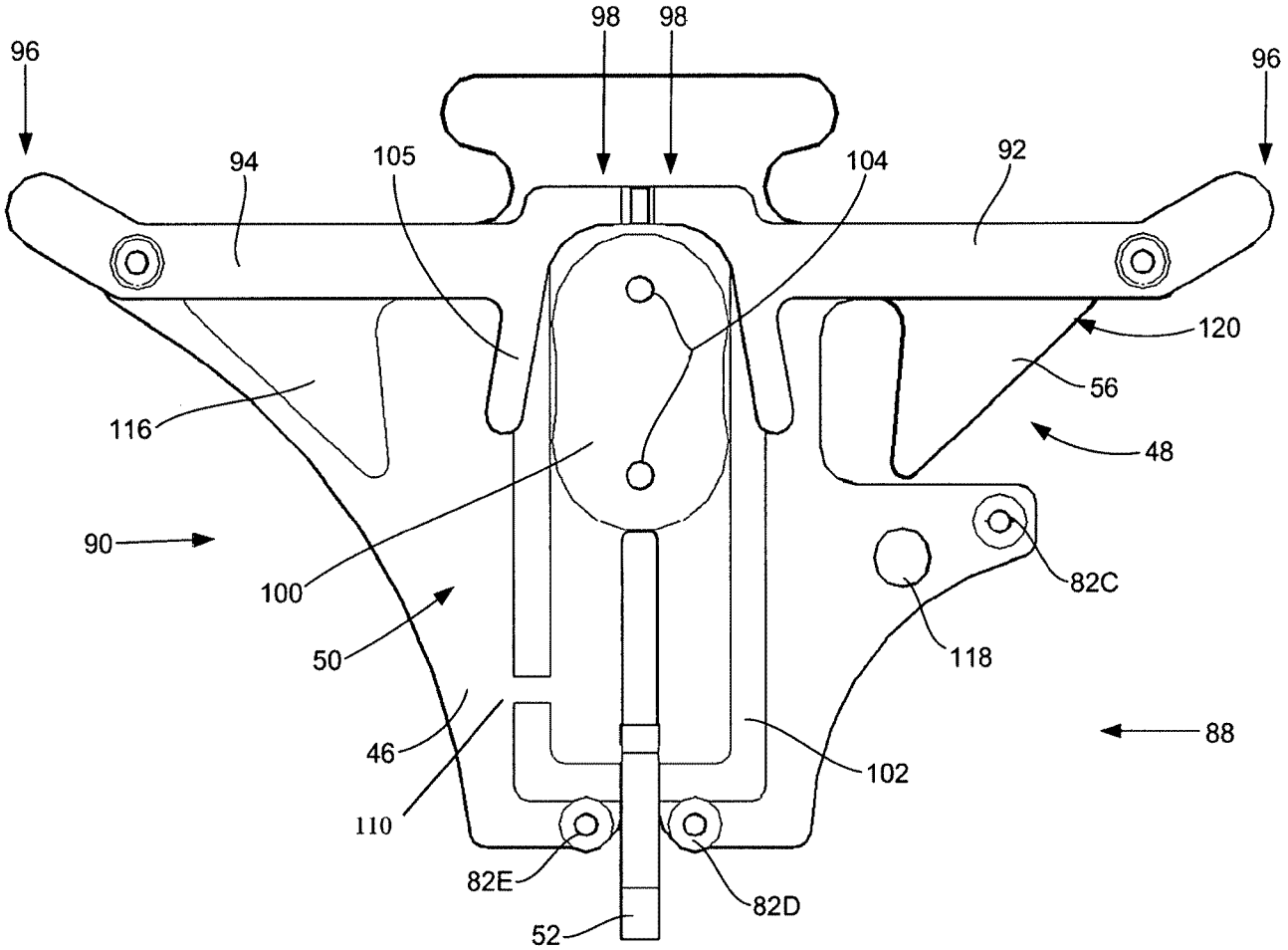
FIG. 12 is a left side view of the gravity gate latch of FIG. 11 shown without the first side plate.

The lever actuating mechanism 50, which is best shown in the partial exploded views in FIGS. 11-15, is structured and arranged to allow the hook member 56 to automatically raise up when contacted from the first (or front) side 88 of the gate latch 10 (where the latch mouth 48 is located), by the strike member 38 as the gate 14 moves to its closed position 28 and to allow the user to manually place the gate latch 10 in its unlatched condition 58 when necessary or desired by the user. As best shown in FIG. 12, the gate latch 10 has a second (or back) side 90, which is directed in an opposite direction from the first (or front) side 88 so as to be generally disposed in the direction of the back area 18 (shown in FIGS. 1 and 2). The lever actuating mechanism 50 generally comprises a pair of lever arms, shown as first (or front) lever arm 92 and second (or back) lever arm 94 (each of which have a first end 96 and a second end 98), a guide spacer 100 and a latch hook 102, as best shown in FIGS. 11 and 12. The configuration, function and operation of these components are set forth in detail below.

Each of the first lever arm 92 and second lever arm 94 are pivotally connected to the spacers 82A and 82B near the upper end 76 of the first side plate 44 and second slide plate 46 so as to pivot relative to the first side plate 44 and second side plate 46 and move the hook plate 54, and therefore the hook member 56 itself upward or downward. The second end 98 of the first lever arm 92 and second lever arm 94 pivot in an upward direction when the user presses downward on the first end 96 of either the first lever arm 92 or second lever arm 94. This will place the gate latch 10 in its unlatched condition 58 so the user can move the hook member 56 out of the way of the strike member 38 to allow the user to disengage the gate latch 10 from the strike member 38. Once disengaged, the user can open the gate 14. Because there are two lever arms (first lever arm 92 and second lever arm 94), one on the first (or front) side 88 and one on the second (or back) side 90, the user can unlatch the gate latch 10 from either the front area 16 or back area 18 by pressing down, respectively, on the first end 96 of first lever arm 92 or the second lever arm 94. As such, the user will not have to reach over the gate 14, walk around to the opposite side of the gate 14 or utilize any string, cord, wire or other elongated member. The first lever arm 92 and second lever arm 94 will pivot in a downward direction due to gravity to place the gate latch 10 in its latched condition 60, when the strike member 38 is in the latch mouth 48, or to close the hook member 56 in the latch mouth 48 in preparation for contact with the strike member 38, when the strike member 38 is not in the latch mouth 48. As will be readily appreciated by persons who are skilled in the relevant art, the lever actuating mechanism 50 of the gate latch 10 is structured and arranged for easy and convenient latching and unlatching of the gate latch 10.

The guide spacer 100 is sized and configured to guide the movement of the hook plate 54 and the first lever arm 92 and second lever arm 94. In one embodiment, the guide spacer 100 is made out of plastic and mounted against the inside wall of the second or gate side plate 46, as best shown in FIGS. 11 and 12. The guide spacer 100 has a pair of mounting holes 104, best shown in FIGS. 11 and 12, that are in alignment with the mounting holes 74 of the first side plate 44 and second side plate 46 so the connecting element that secures the gate latch 10 to the latch post 20 (or other first stationary object) can pass through the guide spacer 100. As best shown in FIG. 12, the guide spacer 100 is positioned generally in the upper half (i.e., toward the upper end 76) of the second side plate 46. The guide spacer 100 is dimensioned to fit in the space 106 defined between the first side plate 44 and second side plate 46 when they are attached together, as shown in FIGS. 3-10, and to engage components of the hook plate 54 and the first lever arm 92 and second lever arm 94, as shown in FIGS. 11-14.

In a preferred embodiment of the present invention, each of the first lever arm 92 and second lever arm 94 have a downward extending (i.e., toward the lower end 78 of the first side plate 44 and second side plate 46) guide arms 105 toward the second end 98 of the first lever arm 92 and second lever arm 94, as best shown in FIG. 12. The guide arms 105 are cooperatively sized and configured with the guide spacer 100 to help direct the first lever arm 92 and second lever arm 94 upward and downward in the space 106 between the connected first side plate 44 and second side plate 46. In the embodiment shown in the figures, the guide arms 105 are disposed in a slight outwardly directed angle to compensate for the angle of the first lever arm 92 and second lever arm 94 as they pivot when the first end 96 of the first lever arm 92 and/or second lever arm 94 is pressed downward by the user to unlatch the gate latch 10.

The latch hook 102 is utilized to draw the lock receiving member 52 upward in the space 106 along the slot 80 of the first side plate 44 and second side plate 46, as best shown in comparing FIGS. 11-12 to FIGS. 13-15, and to evenly raise the hook plate 54 when the user presses downward on the first end 96 of the first lever arm 92 or second lever arm 94 for smooth and easy operation of the gate latch 10 from either the front area 16 or back area 18 sides of the gate 14. The latch hook 102 is attached to or integral with the hook plate 54 so as to extend generally downward (i.e., toward the lower end 78 of the first side plate 44 and second side plate 46) therefrom and sized and configured for a portion of the latch hook 102 to engage a slot 108 in the lock receiving member 52, best shown in FIGS. 13-15, so the lock receiving member 52 will move up and down with the latch hook 102, which itself moves up and down with the hook plate 54. As shown in these figures, the latch hook 102 has an opening 110 through which the lock receiving member 52 is inserted to hang from the latch hook 102 below the lower end 78 of the first side plate 44 and second side plate 46 when the gate latch 10 is in its latched condition 60 with the strike member 38 in the latch mouth 48, behind hook member 56, or if the hook member 56 is closed so as to be in position to be contacted by the strike member 38 when the gate 14 is moved to its closed position 28.

Figure 13:
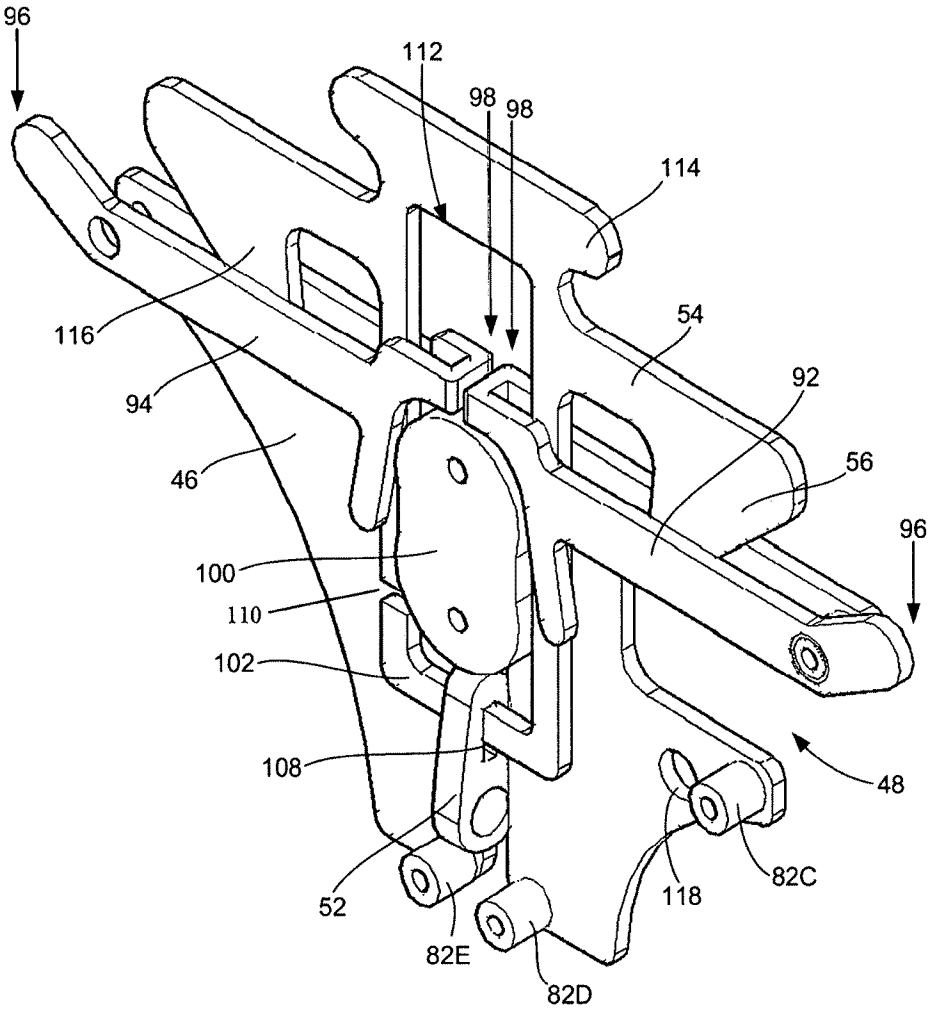
FIG. 13 is a left side perspective view of the gravity gate latch of FIG. 12 shown with the hook plate lifted upward to place the gate latch in its disengaged condition.
Figure 14:
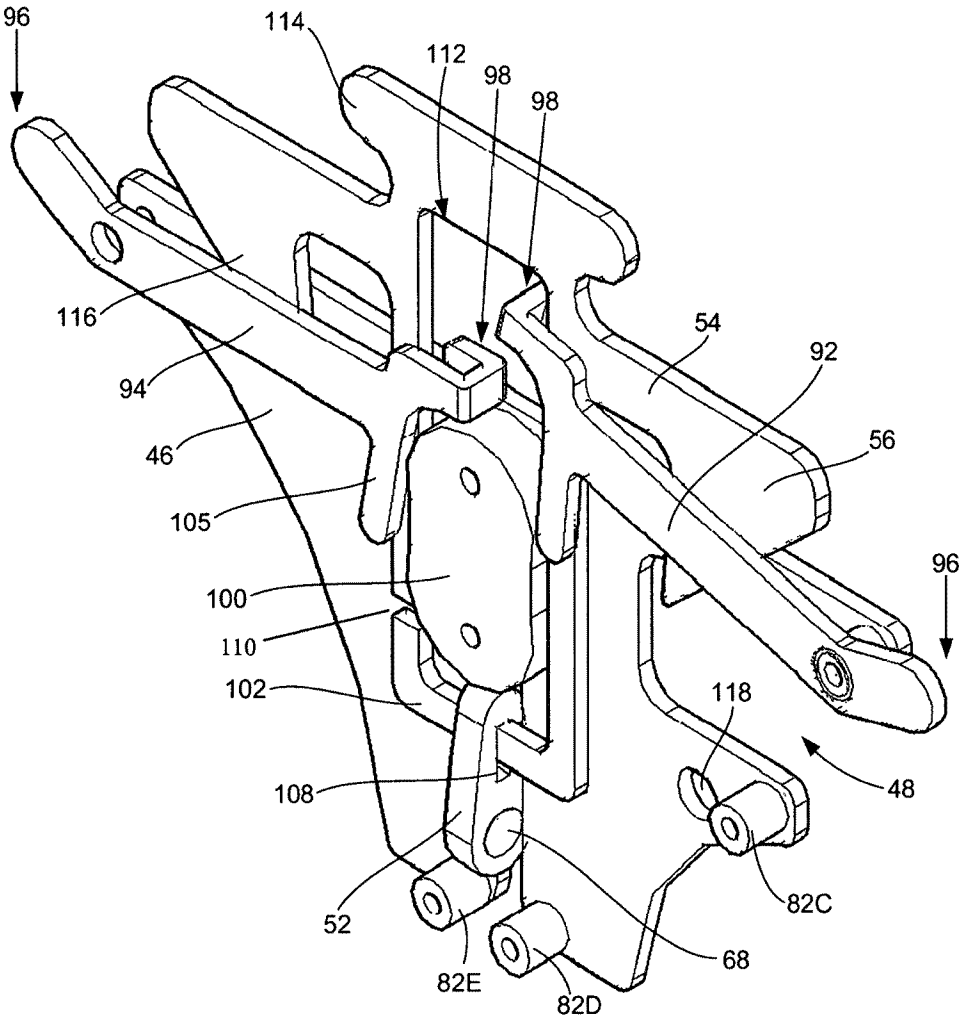
FIG. 14 is a left side perspective view of the gravity gate latch of FIG. 12 shown with the first or front lever arm raising the hook plate upward to place the gate latch in its disengaged position.
Figure 15:
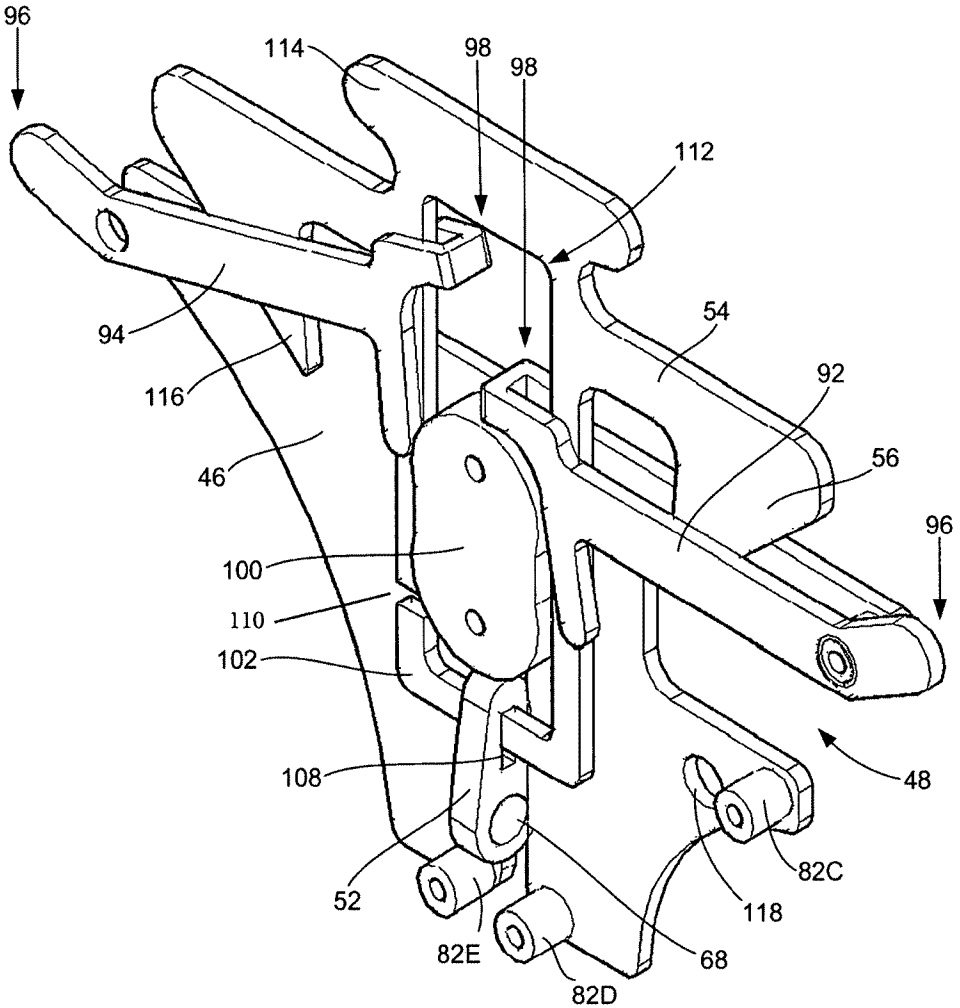
FIG. 15 is a left side perspective view of the gravity gate latch of FIG. 12 shown with the second or back lever arm raising the hook plate upward to place the gate latch in its disengaged position.

The hook plate 54 and latch hook 102, which are preferably integrally formed, define a generally rectangular shaped engagement opening 112, best shown in FIGS. 13-15, that is engaged by the first lever arm 92 and second lever arm 94, the guide spacer 100 and the slot 108 in the lock receiving member 52. With regard to the first lever arm 92 and second lever arm 94, the second end 98 of each the first lever arm 92 and second lever arm 94 is structured and arranged to contact the inside surface of the upper end of the engagement opening 112 to lift the hook plate 54, and therefore the hook member 56, upward when the first end 96 of the first lever arm 92 or second lever arm 94 is pushed downward by the user when he or she wants to pass through the gate 14 from either the front area 16 or back area 18. More specifically, when the user presses downward on the first end 96 of the first lever arm 92 (which he or she will do from the front area 16 side of the gate 14), the lever arm 92 will pivot the second end 98 thereof upward against the inside surface of the upper end of the engagement opening 112 to lift the hook plate 54 and hook member 56 upward so the strike member 38 may be removed from the latch mouth 48. When the user presses downward on the first end 96 of the second lever arm 94 (which he or she will do from the back area 18 side of the gate 14), the lever arm 94 will pivot the second end 98 thereof upward against the inside surface of the upper end of the engagement opening 112 to lift the hook plate 54 and hook member 56 upward so the strike member 38 may be removed from the latch mouth 48. In either direction, with the gate latch 10 in its unlatched condition 58, the user may then open the gate 14 and cross to the front area 16 or back area 18. With regard to the guide spacer 100, the guide spacer 100 engages the inside surfaces of the sides of the engagement opening 112 to evenly guide the hook plate 54 upward so the movement of the hook plate 54 and hook member 56 will be smooth and easy. With regard to the lock receiving member 52, when the hook plate 54 moves upward, as described above, it will engage the upper end of the slot 108 in the lock receiving member 52 and pull the lock receiving member 52 upward (if the shackle 70 of the padlock 66 is not in the aperture 68) along the slot 80 of the first side plate 44 and second side plate 46, as shown in FIGS. 13-15.

In the embodiment shown in the figures, the second end 98 of each of the first lever arm 92 and the second lever arm 94 are bent back to go around the latch hook 102 (i.e., towards the first end 96) to form a generally U-shaped second end 98, as shown in FIGS. 13-15. This configuration allows the latch hook 102 to move freely relative to the first lever arm 92 and second lever arm 94.

Figure 6:
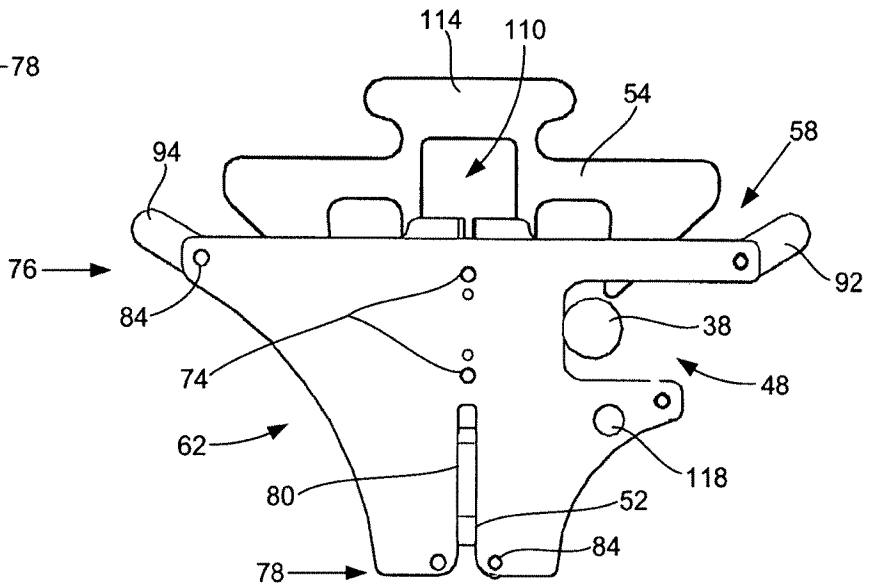
FIG. 6 is a left side view of the gravity gate latch of FIG. 5 shown with the hook plate lifted upward to place the gate latch in its disengaged condition.
Figure 7:
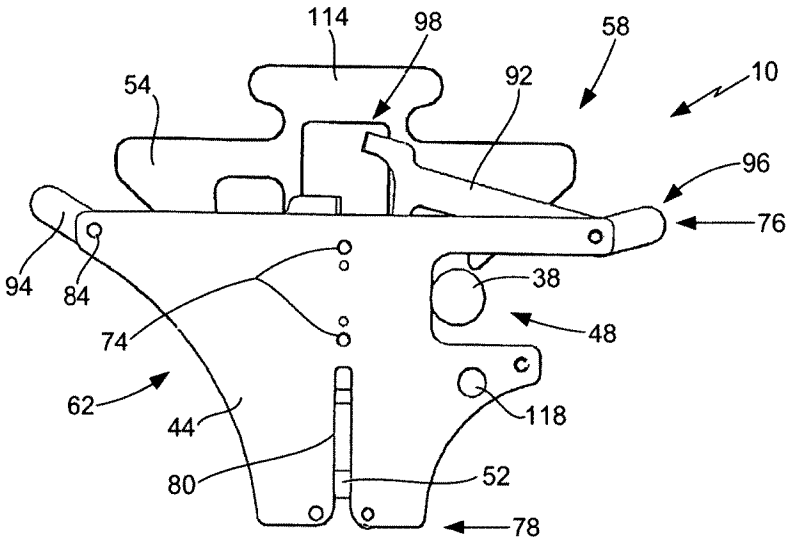
FIG. 7 is a left side view of the gravity gate latch of FIG. 5 shown with the first or front lever raising the hook plate upward to place the gate latch in its disengaged position.
Figure 8:
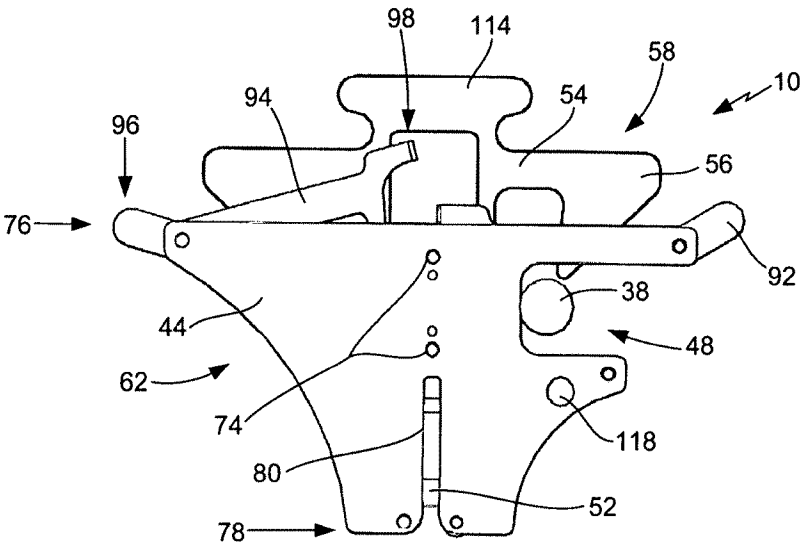
FIG. 8 is a left side view of the gravity gate latch of FIG. 5 shown with the second or back lever raising the hook plate upward to place the gate latch in its disengaged position.
Figure 9:
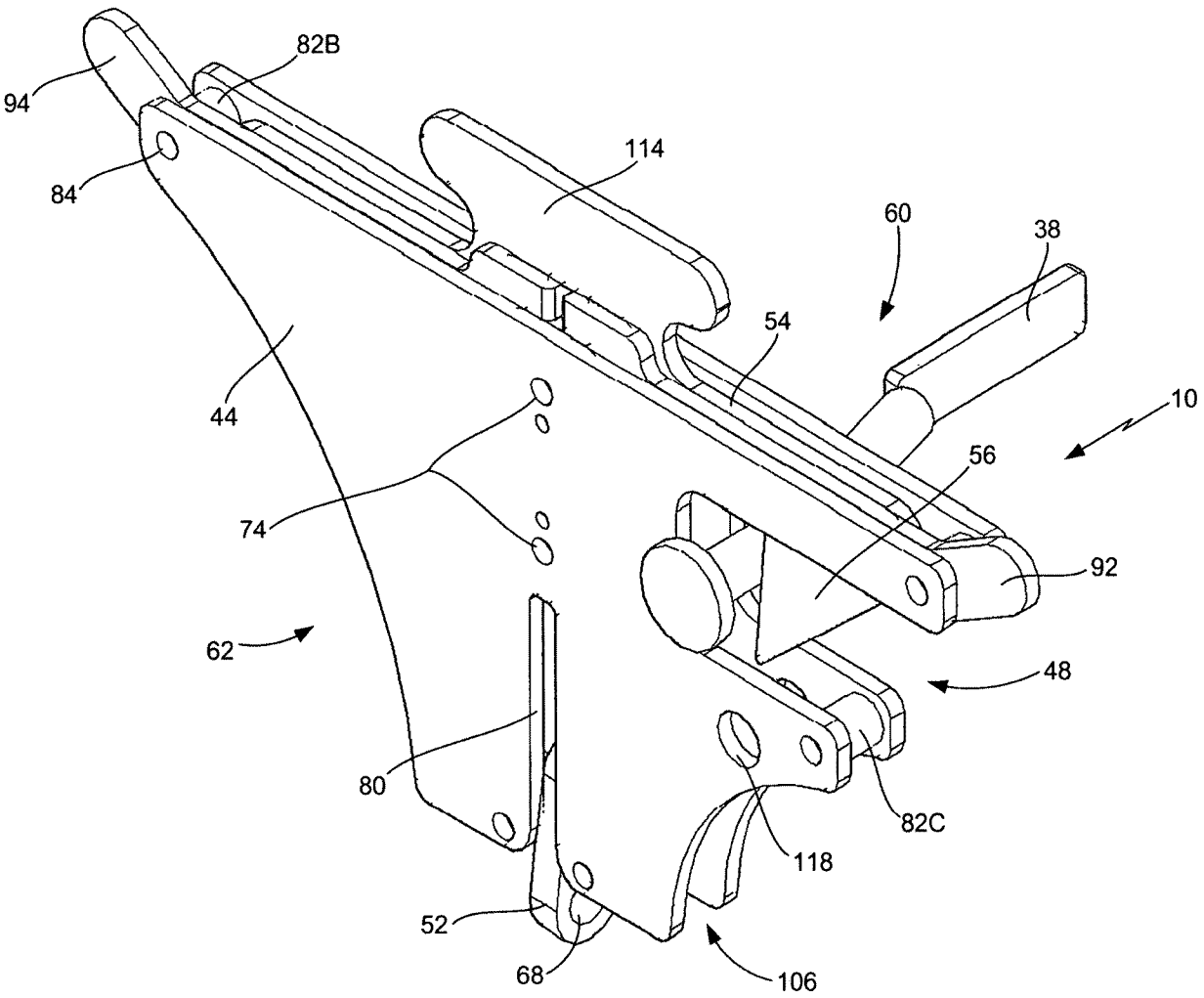
FIG. 9 is a left side perspective view of the gravity gate latch of FIG. 5 shown with the strike member and in its unlocked position.

The above operation of the gate latch 10 to move the gate latch 10 to its unlatched condition 58 utilizes the first lever arm 92 and second lever arm 94. In a preferred configuration of the gate latch 10 of the present invention, the gate latch 10 also has a pull plate 114 attached to or integral with the upper end of the hook plate 54 so as to extend above the upper end 76 of the first side plate 44 and second side plate 46, as best shown in FIGS. 5-15. In the embodiment shown in the figures, the pull plate 114 is integral with the hook plate 54, as best shown in FIGS. 6-8 and 13-15. The pull plate 114 is sized and configured to be grasped by the user and pulled upward (away from the upper end 76 of the first side plate 44 and second side plate 46) to pull the hook member 56 out of the latch mouth 48 to place the gate latch 10 in its unlatched condition 58 so the strike member 38 can be removed from the latch mouth 48, as shown in FIGS. 6-8, and the gate 14 moved to its open position 30. With the gate latch 10 attached to the latch post 20 (or other first stationary object) and positioned in the gap 72 between the first (or free) end 24 of the gate 14 and the latch post 20, the user merely has to reach into the gap 72 and pull upward on the pull plate 114 to place the gate latch 10 in its unlatched condition 58 (with no padlock 66 in place).

In a preferred configuration of the gate latch 10 of the present invention, all of the components except the spacers 82A, 82B, 82C, 82D and 82E and the guide spacer 100 are made out of steel or other metal that is selected to be rigid and strong. To be substantially corrosion resistant, it is preferred that these components are painted, powder coated or otherwise treated. When manufacturing the components, they can be laser cut or formed by other processes well known in the relevant art. In one embodiment, the hook plate 54 also has a hook-shaped member 116 at the second (or back) side 90 of the gate latch 10, as best shown in FIGS. 11 and 12, to provide symmetry, balance and allow the hook plate 54 to be placed in the space 106 between the first side plate 44 and second side plate 46 in either direction. When putting the gate latch 10 together, the guide spacer 100 is placed against the second side plate 46 in a pair of small sized predrilled guide holes. The lock receiving member 52 is slid onto the latch hook 102 by positioning the slot 108 of the lock receiving member 52 in the opening 110 in the latch hook 102 and then directing it towards the bottom end of the latch hook 102. The latch hook 102, with the lock receiving member 52 at the bottom thereof, is placed onto the second side plate 46 with the guide spacer 100 in the middle of the latch hook 102. This also positions the hook plate 54 in position with the hook member 56 at the latch mouth 48. Rivets or other plate connectors 84 are placed into the connector apertures 86 of the second side plate 46 and the spacers 82A, 82B, 82C, 82D and 82E are placed onto the plate connectors 84. The lower three spacers 82C, 82D and 82E can be cylindrically shaped. The upper two spacers 82A and 82B, which are each associated with one of the first lever arm 92 and second lever arm 94, respectively, are sized and configured to be spacers/bearings to allow the first lever arm 92 and second lever arm 94 to pivot relative to the first side plate 44 and second side plate 46. The bent second ends 98 of each of the first lever arm 92 and second lever arm 94 are placed on the latch hook 102 at the engagement opening 112 thereof and the first lever arm 92 and second lever arm 94 are engaged with their respective spacers 82A and 82B (which also serve as bearings). Once the components of the lever actuating mechanism 50 and the hook plate 54 are in position, the first side plate 44 is placed on the assembly, with the connector apertures 86 thereof aligned with the plate connectors 84 so the plate connectors 84 go through the first side plate 44 and then secure the plate connectors 84.

As set forth above, the gate latch 10 of the present invention is sized and configured to be attached to the first stationary object (i.e., latch post 20) and positioned laterally (i.e., from the first (or front) side 88 to the second (or back) side 90 of the gate latch 10) in the gap 72 between the first (or free) end 24 of the gate 14. The lock receiving member 52 is positioned on the gate latch 10 such that when the shackle 70 is received in the aperture 68, the padlock 66 will hang below the gate latch 10 in the gap 72, as can be readily understood by viewing FIGS. 1 and 10. As such, a person wanting to lock or unlock the gate 14 will be able to easily reach, rotate and manipulate the padlock 66, such as by using a key or operating a combination mechanism, to place the gate 14 in its unlocked condition 62 (i.e., no padlock 66) or its locked condition 64 (i.e., shackle 70 in the aperture of the lock receiving member 52). With the padlock 66 in place, the gate latch 10 cannot be moved to its unlatched condition 58, because the upper end of the shackle 70 will bump against the spacers 82D and 82E at the lower end 78 of the first side plate 44 and second side plate 46 and prevent the hook plate 54 from moving upward enough for the hook member 56 to clear space for the strike member 38 to move out of the latch mouth 48. Although this is required for security (i.e., preventing unauthorized persons from passing through the gate 14), it can be difficult if an authorized person wants to pass through the gate 14 when the gate 14 is in its locked condition 64. Unlike other gravity gate latches, which allow access to the padlock 66 from only one side of the gate 14, the gate latch 10 of the present invention will allow a person to always be "on the right side" of the gate 14 with regard to being able to reach the padlock 66 for locking or unlocking the gate 14.

In the preferred embodiments of the gate latch 10 of the present invention, the gate latch 10 is provided with several features that enhance the effectiveness and use of the gate latch 10. One such feature is the addition of one or more padlock apertures 118 in the first side plate 44 and second side plate 46 that is provided as a place to store the padlock 66 when it is not in use in the lock receiving member 52. As will be readily appreciated by persons who use gravity gate latches, once the padlock 66 is removed to unlock the gate 14 and the gate 14 is to remain unlocked, there is usually no convenient location to set down or otherwise place the padlock 66 until it is time to lock the gate 14. With the gate latch 10 of the present invention, the user can place the shackle 70 of the padlock 66 through the padlock apertures 118 and let the padlock 66 hang there until it is time to lock the gate 14. The padlock apertures 118 in the first side plate 44 and second side plate 46 are positioned toward the first side 88 and/or the second side 90 of the gate latch 10 (shown generally toward the first side 88 in the figures). The padlock apertures 118 must be sized and configured to receive the shackle 70 of a typical padlock 66. In addition to providing a place to store the padlock 66, the padlock apertures 118 allow the user to leave the gate 14 unlocked (i.e., no padlock 66 in the lock receiving member 52), but provide an illusion that in fact the gate 14 is locked. For instance, from the front area 16 a person will see the padlock 66 in the padlock apertures 118 and, without detailed inspection, will assume that the locked padlock 66 hanging from the gate latch 10 is locking the gate 14 and will be unlikely to even approach the gate 14 in an attempt to gain unauthorized entry into the back area 18. The padlock aperture 118 feature will provide added security for the user.

Another feature preferably provided with the gate latch 10 of the present invention is that the hook member 56 is provided with an elongated edge 120, shown in FIG. 12, that provides greater tolerance for receiving the strike member 38 inside the latch mouth 48 of the gate latch 10. As well known in the art, many gates 14 of the type that are utilized with gate latch 10 have a tendency to sag, shift or otherwise move due to wood swelling, disrepair or improper build. The elongated edge 120 of the hook member 56, angling away from the first (or front) side 88 of the gate latch 10, provides increased tolerance for receiving the strike member 38 against the hook member 56 to receive the strike member 38 into the latch mouth 48 in case the gate 14 sags, shifts or otherwise moves.

In use, the user unlatches the gate latch 10 (when there is no padlock 66 in the lock receiving member 52) by pushing down on the first end 96 of the first lever arm 92 or second lever arm 94, depending on whether he or she is in the front area 16 or back area 18 side of the gate 14, or by pulling upward on the pull plate 114, which can be done from either side of the gate 14. The gate 14 is then free to swing to its open position 30. To latch the gate 14, the round section of the metal strike member 38 hits the angled face (i.e., the elongated edge 120) of the hook member 56, causing the hook plate 54 to lift upward and allow the strike member 38 to pass into the latch mouth 48. Once the strike member 38 has passed the bottom of the elongated edge 120 of the hook member 56 gravity causes the hook plate 54 to fall back into place, thereby capturing the strike member 38 in the latch mouth 48 behind the hook member 56 to securely place the gate 14 in its latched condition 60. At the bottom of the gate latch 10 (i.e., at the lower end 78 of the first side plate 44 and second side plate 46) there is a unique tear-drop shaped lock receiving member 52, with an aperture 68 therein, that is attached to the latch hook 102. To place the gate 14 in its locked condition 64, the user inserts the shackle 70 of a padlock 66 through the aperture 68 of the lock receiving member 52 and locks the padlock 66. With the shackle 70 of the padlock 66 inserted into the aperture 68 of the lock receiving member 52, the latch hook 102 is not able to move sufficiently upward into the space 106 to allow the hook member 56 to move out of the latch mouth 48 due to the upper end of the shackle 70 contacting the two spacers 82D and 82E at the lower end 78 of the first side plate 44 and second side plate 46, thereby maintaining the gate latch 10 in its locked condition 64 and unable to move to its unlatched condition 58. Because the gate latch 10 is mounted in the gap 72 between the first stationary object (i.e., latch post 20) and first (or free) end 24 of the swinging gate 14, the user can conveniently and easily rotate the padlock 66 to the side of the gate 14 (i.e., toward the front area 16 or back area 18) where he or she is standing to lock or unlock the padlock 66.

The unique design of the gravity gate latch 10 of the present invention allows it to be mounted in the gap 72 between the latch post 20 and the first (or free) end 24 of the gate 14. By placing the gate latch 10 between the latch post 20 and the gate 14, the gate latch 10 solves the problem of the inconvenience and difficulty of getting to the gate latch 10 or the padlock 66 when they are only readily accessible from one side of the gate 14. This unique design allows the user to securely and automatically latch and unlatch and easily and conveniently lock and unlock the gate latch 10 from either side of the gate 14. The first lever arm 92 and second lever arm 94, which extend beyond the outer edges of, respectively, the first side plate 44 and the second side plate 46, provide for easy opening from both sides of the gate 14. The large open latch mouth 48 and the longer elongated edge 120 of the hook member 56 allows the strike member 38 attached to the gate 14 to be more easily engaged and not jam.

While there are shown and described herein specific forms of the invention, it will be readily apparent to those skilled in the art that the invention is not so limited, but is susceptible to various modifications and rearrangements in design and materials without departing from the spirit and scope of the invention. In particular, it should be noted that the present invention is subject to modification with regard to any dimensional relationships set forth herein and modifications in assembly, materials, size, shape and use. For instance, there are numerous components described herein that can be replaced with equivalent functioning components to accomplish the objectives of the present invention.

What is claimed is:

1. A gate latch having a lateral front side and a lateral back side, said gate latch comprising:

a) a first side plate and a second side plate, each comprising a mouth defined therein at said front side of said gate latch;

b) a hook plate between said first side plate and said second side plate, said hook plate comprising a hook member between said mouth of said first side plate and said mouth of said second side plate, a latch hook, and an engagement opening;

c) a lock receiving member engaged with said latch hook through said engagement opening;

d) at least one lever arm between said first side plate and said second side plate; and e) a plurality of spacers, each of said spacers being between, and fixedly engaged with, said first side plate and said second side plate.

2. The gate latch of claim 1, wherein said at least one lever arm is pivotally engaged with a corresponding one of said plurality of spacers, and engaged at a proximal end with said hook plate.

3. The gate latch of claim 2, wherein said at least one lever arm comprises a first lever arm and a second lever arm, wherein said first lever arm is at said front side of said gate latch and said second lever arm is at said back side of said gate latch.

4. The gate latch of claim 2, wherein said at least one lever arm is engaged at said proximal end with said hook plate through said engagement opening.

5. The gate latch of claim 2, further comprising a guide spacer between said first side plate and said second side plate, wherein said guide spacer is positioned within said engagement opening.

6. The gate latch of claim 5, wherein said at least one lever arm comprises a guide arm at said proximal end thereof and positioned near said guide spacer.

7. The gate latch of claim 1, wherein said lock receiving member comprises a slot, wherein a portion of said latch hook of said hook plate is positioned in said slot.

8. The gate latch of claim 7, wherein said latch hook comprises an opening adapted for allowing said portion of said latch hook to be positioned in said slot of said lock receiving member.

9. The gate latch of claim 1, wherein said lock receiving member comprises an aperture adapted to receive a shackle of a lock.

10. The gate latch of claim 1, wherein said first side plate and said second side plate each further comprise a slot positioned therein, wherein said lock receiving member is slidably engaged in said slot of said first side plate and said slot of said second side plate.

11. The gate latch of claim 1, wherein said hook plate further comprises a pull plate.

12. The gate latch of claim 1, wherein said hook plate further comprises a second hook member at said back side of said gate latch.

13. The gate latch of claim 1, wherein said first side plate and said second side plate each further comprise a padlock aperture adapted to receive a shackle of a lock.

14. The gate latch of claim 1, wherein said latch hook and said lock receiving member are each medially positioned in said gate latch, and wherein said mouth of said first side plate, said mouth of said second side plate, and said hook member are laterally positioned in said gate latch.

15. The gate latch of claim 1, wherein said at least one lever arm comprises a first lever arm and a second lever arm, further comprising a guide spacer between said first side plate and said second side plate, wherein said first side plate and said second side plate each further comprise a slot therein, wherein said hook plate further comprises a pull plate and a second hook member at said back side of said gate latch, wherein said latch hook comprises an opening, and wherein said lock receiving member comprises a slot and an aperture.

16. The gate latch of claim 15, wherein said first lever arm and said second lever arm are each pivotally engaged with a corresponding one of said plurality of spacers, wherein said first lever arm and said second lever arm are each engaged at a proximal end with said hook plate through said engagement opening, wherein said guide spacer is positioned within said engagement opening, wherein a portion of said latch hook of said hook plate is positioned in said slot of said lock receiving member, wherein said opening of said latch hook is adapted for allowing said portion of said latch hook of said hook plate to be positioned in said slot of said lock receiving member, wherein said aperture of said lock receiving member is adapted to receive a shackle of a lock, wherein said lock receiving member is slidably engaged in said slot of said first side plate and said slot of said second side plate, wherein said guide spacer, said latch hook, said lock receiving member, said slot in said first side plate, and said slot in said second side plate are each medially positioned in said gate latch, and wherein said mouth of said first side plate, said mouth of said second side plate, and said hook member are laterally positioned in said gate latch.

17. A gate system comprising:

a) a gate having a front side having a strike member engaged therewith and a back side;

b) a latch post, wherein a gap is defined between said gate and said latch post;

c) a lock having a shackle; and d) a gate latch positioned in said gap, said gate latch comprising (1) a first side plate and a second side plate, each having a mouth defined therein for receiving a portion of said strike member when said gate is in a closed position;

(2) a hook plate between said first side plate and said second side plate, said hook plate comprising a hook member and a latch hook, said hook member positioned for capturing said strike member in said mouth of said first side plate and said mouth of said second side plate when said gate is in the closed position;

(3) a first lever arm and a second lever arm, wherein a distal end of said first lever arm protrudes from said front side of said gate and a distal end of said second lever arm protrudes from said back side of said gate, wherein said first lever arm and said second lever arm are each pivotally engaged to said first side plate and said second side plate and are each engaged at a proximal end thereof with said hook plate; and (4) a lock receiving member engaged with said latch hook and positioned in said gap between said gate and said latch post, said lock receiving member comprising an aperture receiving said shack of said lock.

18. The gate system of claim 17, wherein said hook plate further comprises an engagement opening.

19. The gate system of claim 18, further comprising a guide spacer within said engagement opening.

20. The gate system of claim 18, wherein said proximal end of said first lever arm and said proximal end of said second lever arm are each engaged with said hook plate through said engagement opening.

21. The gate system of claim 18, wherein said lock receiving member is engaged with said latch hook through said engagement opening.

22. The gate system of claim 21, wherein said proximal end of said first lever arm and said proximal end of said second lever arm are each engaged with said hook plate through said engagement opening.

23. A method of opening a gate from a back side thereof, said gate having front side with a strike member thereon captured in a mouth of a gate latch by a hook member, wherein said gate latch is positioned in a gap between said gate and a latch post, said method comprising the steps of:

a) pressing down on a distal end of a lever arm protruding from said gap on said back side of said gate;

b) pivoting said lever arm around a spacer engaged between a first side plate and a second side plate of said gate latch;

c) raising, with a proximal end of said lever arm, a hook plate engaged with said hook member and positioned between said first side plate and said second side plate; and d) raising a lock receiving member engaged with a bottom portion of said hook plate.

24. A gate latch having a front side and a bottom side comprising:

a) a first side plate, a second side plate, and a plurality of spacers between said first side plate and said second side plate, wherein said first side plate is engaged with said second side plate with said plurality of spacers;

b) a hook plate between said first side plate and said second side plate, said hook plate comprising a hook member at said front side, a latch hook, and an engagement opening;

c) a lock receiving member, wherein a first portion of said lock receiving member is engaged with said latch hook of said hook plate through said engagement opening, and wherein a second portion of said lock receiving member comprises an aperture adapted to receive a shackle of a lock at said bottom side; and d) a lever arm pivotally engaged with one of said spacers, wherein said lever arm has a first end at said front side and a second end engaged with said hook plate through said engagement opening.

* * * * *